US009842532B2

(12) United States Patent
Motta

(10) Patent No.: US 9,842,532 B2
(45) Date of Patent: Dec. 12, 2017

(54) REMOTE DISPLAY RENDERING FOR ELECTRONIC DEVICES

(71) Applicant: Nvidia Corporation, Santa Clara, CA (US)

(72) Inventor: Ricardo J. Motta, Palo Alto, CA (US)

(73) Assignee: Nvidia Corporation, Santa Clara, CA (US)

( * ) Notice: Subject to any disclaimer, the term of this patent is extended or adjusted under 35 U.S.C. 154(b) by 68 days.

(21) Appl. No.: 14/021,803

(22) Filed: Sep. 9, 2013

(65) Prior Publication Data

US 2015/0070400 A1 Mar. 12, 2015

(51) Int. Cl.
*G09G 3/20* (2006.01)
*G09G 3/34* (2006.01)

(52) U.S. Cl.
CPC ..... *G09G 3/2092* (2013.01); *G09G 3/3406* (2013.01); *G09G 2320/0626* (2013.01); *G09G 2340/14* (2013.01); *G09G 2360/144* (2013.01); *G09G 2370/02* (2013.01); *G09G 2370/042* (2013.01)

(58) Field of Classification Search
CPC ..... G09G 2370/042; G09G 3/3406; G09G 2320/0626; G09G 2340/14; G09G 2340/145; G09G 2360/144; G09G 2370/02; G09G 2320/0271; G09G 2320/06; G09G 2320/066; G09G 2370/022; G09G 2320/0693; G06F 3/14; H04N 21/44227; H04N 21/4516; H04N 21/422
USPC ..... 345/690; 707/E17.121, 999.104, 707/999.107; 715/744
See application file for complete search history.

(56) References Cited

U.S. PATENT DOCUMENTS

| | | | |
|---|---|---|---|
| 4,603,400 | A | 7/1986 | Daniels |
| 4,955,066 | A | 9/1990 | Notenboom |
| 5,016,001 | A | 5/1991 | Minagawa et al. |
| 5,321,510 | A | 6/1994 | Childers et al. |
| 5,371,847 | A | 12/1994 | Hargrove |
| 5,461,679 | A | 10/1995 | Normile et al. |
| 5,499,334 | A | 3/1996 | Staab |
| 5,517,612 | A | 5/1996 | Dwin et al. |
| 5,564,002 | A | 10/1996 | Brown |

(Continued)

FOREIGN PATENT DOCUMENTS

| | | |
|---|---|---|
| WO | WO2007016660 | 2/2007 |
| WO | WO2010078539 | 7/2010 |

OTHER PUBLICATIONS

Anthony Leather, Intel Xeon E5-2670 Review. Published on Mar. 6, 2012. http://www.bit-tech.net/hardwar/cpus/2012/03/06intel-xeon-e5-2670-review/1. 2 Pages.

(Continued)

*Primary Examiner* — Abhishek Sarma

(57) ABSTRACT

An image is remotely processed over a network. An electronic device is characterized based on a unique identifier associated therewith and properties data, which relate to display related properties of the device. Local data is collected from the device in relation to real-time conditions and control data and, which correspond to the device in relation to the characterizing. The image is remotely generated for download to the device and includes processing data. The processing data are based on the properties data and the local data.

23 Claims, 7 Drawing Sheets

Example Mobile Device Display Control System 10

Example Remote Rendering Process 70

(56) References Cited

U.S. PATENT DOCUMENTS 5,687,334 A 11/1997 Davis et al.
5,689,666 A 11/1997 Berquist et al.
5,708,786 A 1/1998 Teruuchi
5,712,995 A 1/1998 Cohn
5,734,380 A 3/1998 Adams et al.
5,768,164 A 6/1998 Hollon, Jr.
5,796,403 A 8/1998 Adams et al.
5,841,435 A 11/1998 Dauerer et al.
5,900,913 A 5/1999 Tults
5,920,313 A 7/1999 Diedrichsen et al.
5,923,307 A 7/1999 Hogle, IV
5,977,973 A 11/1999 Sobeski et al.
5,978,042 A 11/1999 Vaske et al.
6,003,067 A 12/1999 Suzuki et al.
6,008,809 A 12/1999 Brooks
6,018,340 A 1/2000 Butler et al.
6,075,531 A 6/2000 DeStefano
6,133,918 A 10/2000 Conrad et al.
6,191,758 B1 2/2001 Lee
6,226,237 B1 5/2001 Chan et al.
6,335,745 B1 1/2002 Amro et al.
6,337,747 B1 1/2002 Rosenthal
6,377,257 B1 4/2002 Borrel et al.
6,433,800 B1 8/2002 Holtz
6,437,803 B1 8/2002 Panasyuk et al.
6,463,459 B1 10/2002 Orr et al.
6,483,502 B2 11/2002 Fujiwara
6,498,721 B1 12/2002 Kim
6,549,271 B2 4/2003 Yasuda et al.
6,590,594 B2 7/2003 Bates et al.
6,600,500 B1 7/2003 Yamamoto
6,628,243 B1 9/2003 Lyons et al.
6,630,943 B1 10/2003 Nason et al.
6,633,906 B1 10/2003 Callaway et al.
6,654,826 B1 11/2003 Cho et al.
6,664,983 B2 12/2003 Ludolph
6,686,936 B1 2/2004 Nason et al.
6,710,788 B1 3/2004 Freach et al.
6,710,790 B1 3/2004 Fagioli
6,724,403 B1 4/2004 Santoro et al.
6,774,912 B1 8/2004 Ahmed et al.
6,784,855 B2 8/2004 Matthews et al.
6,816,977 B2 11/2004 Brakmo et al.
6,832,355 B1 12/2004 Duperrouzel et al.
6,873,345 B2 3/2005 Fukuda et al.
6,915,490 B1 7/2005 Ewing
6,956,542 B2 10/2005 Okuley et al.
6,957,395 B1 10/2005 Jobs et al.
7,007,070 B1 2/2006 Hickman
7,010,755 B2 3/2006 Anderson et al.
7,030,837 B1 4/2006 Vong et al.
7,034,776 B1 4/2006 Love
7,047,500 B2 5/2006 Roelofs
7,124,360 B1 10/2006 Drenttel et al.
7,129,909 B1 10/2006 Dong et al.
7,159,189 B2 1/2007 Weingart et al.
7,171,622 B2 1/2007 Bhogal
7,203,944 B1 4/2007 van Rietschote et al.
7,212,174 B2 5/2007 Johnston et al.
7,269,797 B1 9/2007 Bertocci et al.
7,346,855 B2 3/2008 Hellyar et al.
7,359,998 B2 4/2008 Chan et al.
7,370,284 B2 5/2008 Andrea et al.
7,461,088 B2 12/2008 Thorman et al.
7,486,279 B2 2/2009 Wong et al.
7,490,297 B2 2/2009 Bates et al.
7,509,444 B2 3/2009 Chiu et al.
7,519,910 B2 4/2009 Saka
7,523,414 B2 4/2009 Schmidt et al.
7,552,391 B2 6/2009 Evans et al.
7,555,528 B2 6/2009 Rezvani et al.
7,558,884 B2 7/2009 Fuller et al.
7,594,185 B2 9/2009 Anderson et al.
7,612,783 B2 11/2009 Koduri et al.
7,698,178 B2 4/2010 Chu
7,698,360 B2 4/2010 Rowley et al.
7,739,604 B1 6/2010 Lyons et al.
7,739,617 B2 6/2010 Ording et al.
7,913,183 B2 3/2011 Czerwinski et al.
7,933,829 B2 4/2011 Goldberg et al.
7,953,657 B2 5/2011 West
7,996,785 B2 8/2011 Neil
7,996,789 B2 8/2011 Louch et al.
8,135,626 B2 3/2012 Das et al.
8,176,155 B2 5/2012 Yang et al.
8,190,998 B2 5/2012 Bitterlich
8,335,539 B1 12/2012 Wu
8,406,992 B2 3/2013 Laumeyer et al.
8,464,250 B1 6/2013 Hardy et al.
8,572,407 B1 10/2013 Chengottarasappan et al.
8,743,019 B1 6/2014 Eng
8,910,201 B1 12/2014 Zamiska et al.
9,197,642 B1 11/2015 Urbach
9,471,401 B2 10/2016 Munshi et al.
2001/0028366 A1 10/2001 Ohki et al.
2002/0054141 A1 5/2002 Yen et al.
2002/0057295 A1 5/2002 Panasyuk et al.
2002/0087225 A1 7/2002 Howard
2002/0087403 A1 7/2002 Meyers et al.
2002/0129288 A1 9/2002 Loh et al.
2002/0140627 A1 10/2002 Ohki
2002/0163513 A1 11/2002 Tsuji
2002/0170067 A1 11/2002 Norstrom et al.
2002/0175933 A1 11/2002 Ronkainen et al.
2002/0186257 A1 12/2002 Cadiz et al.
2002/0196279 A1 12/2002 Bloomfield et al.
2003/0016205 A1 1/2003 Kawabata et al.
2003/0025689 A1 2/2003 Kim
2003/0041206 A1 2/2003 Dickie
2003/0065934 A1 4/2003 Angelo et al.
2003/0088800 A1 5/2003 Cai
2003/0090508 A1 5/2003 Keohane et al.
2003/0126335 A1 7/2003 Silvester
2003/0177172 A1 9/2003 Duursma et al.
2003/0179240 A1 9/2003 Gest
2003/0179244 A1 9/2003 Erlingsson
2003/0188144 A1 10/2003 Du et al.
2003/0189597 A1 10/2003 Anderson et al.
2004/0044567 A1 3/2004 Willis
2005/0028200 A1 2/2005 Sardera
2005/0088445 A1 4/2005 Gonzalez et al.
2005/0218943 A1 10/2005 Padhye et al.
2005/0270298 A1 12/2005 Thieret
2006/0111967 A1 5/2006 Forbes
2006/0240894 A1 10/2006 Andrews
2006/0248256 A1 11/2006 Liu et al.
2007/0061202 A1 3/2007 Ellis et al.
2007/0067535 A1 3/2007 Liu
2007/0155195 A1 7/2007 He et al.
2007/0195099 A1 8/2007 Diard et al.
2007/0217716 A1* 9/2007 Marriott et al. ..... 382/305
2007/0253594 A1 11/2007 Lu et al.
2007/0294512 A1 12/2007 Crutchfield et al.
2007/0299682 A1 12/2007 Roth et al.
2008/0139306 A1 6/2008 Lutnick et al.
2008/0214104 A1* 9/2008 Baumert et al. ..... 455/3.06
2008/0276220 A1 11/2008 Munshi et al.
2008/0307244 A1 12/2008 Bertelsen et al.
2009/0033676 A1 2/2009 Cybart et al.
2009/0125226 A1 5/2009 Laumeyer et al.
2009/0144361 A1 6/2009 Nobakht et al.
2009/0248534 A1 10/2009 Dasdan et al.
2010/0122286 A1 5/2010 Begeja et al.
2010/0125529 A1 5/2010 Srinivasan et al.
2010/0228521 A1 9/2010 Hamamoto
2010/0231044 A1 9/2010 Tatsumi et al.
2010/0332331 A1 12/2010 Etchegoyen
2011/0102443 A1 5/2011 Dror et al.
2011/0131153 A1* 6/2011 Grim et al. ..... 705/400
2011/0205680 A1 8/2011 Kidd et al.
2011/0218025 A1 9/2011 Katz et al.
2011/0292057 A1 12/2011 Schmit et al.
2011/0296452 A1 12/2011 Yu et al.
2011/0304634 A1 12/2011 Urbach

(56) References Cited

U.S. PATENT DOCUMENTS

| | | | | |
|---|---|---|---|---|
| 2011/0314314 | A1 | 12/2011 | Sengupta | |
| 2012/0076197 | A1 | 3/2012 | Byford et al. | |
| 2012/0149464 | A1 | 6/2012 | Bone et al. | |
| 2012/0172088 | A1 | 7/2012 | Kirch et al. | |
| 2012/0220372 | A1 | 8/2012 | Cheung et al. | |
| 2012/0229526 | A1* | 9/2012 | Holmes et al. | 345/690 |
| 2012/0232988 | A1 | 9/2012 | Yang et al. | |
| 2012/0324358 | A1 | 12/2012 | Jooste | |
| 2013/0021353 | A1 | 1/2013 | Drebin et al. | |
| 2013/0158892 | A1 | 6/2013 | Heron et al. | |
| 2013/0210493 | A1 | 8/2013 | Tal et al. | |
| 2013/0290711 | A1 | 10/2013 | Rajkumar et al. | |
| 2014/0009576 | A1 | 1/2014 | Hadzic et al. | |

OTHER PUBLICATIONS

Ryan Schrout, Galaxy GeForce GT 640 GC 1GB DDR3 Review-GK107 is no GK104. http://www.pcper.com/reviews/Graphics-Cards/Galaxy-GeForce-GT-640-GC-1GB-DDR3-Review-GK107-no-GK104. Date on Jun. 20, 2012. 7 Pages.

* cited by examiner

Example Mobile Device Display Control System 10

Example Characterization Feature 20

Example Output Stage 40

Example Remote Rendering System & Network/Cloud Platform 600

REMOTE DISPLAY RENDERING FOR ELECTRONIC DEVICES

TECHNOLOGY

Embodiments of the present invention relate generally to power management in an electronic device, e.g., a mobile device. More particularly, an example embodiment of the present invention relates to remote display rendering for mobile devices.

BACKGROUND

Mobile devices are in almost ubiquitous use in contemporary social, industrial and commercial endeavors. Mobile devices include familiar portable electronic computing and communicating devices such as cellular and "smart" telephones, personal digital assistants (PDA), laptop, "pad" style and handheld computers, calculators, and gaming devices. These and somewhat more specialized mobile devices, such as geo-locating/navigating and surveying equipment, electrical, electronic, test, calibration, scientific, medical, forensic/military and other instrumentation packages, have or provide a wide range and spectrum of utility.

In addition to networks, databases, and other communicative, computing and data storage and access infrastructures with which they operate, the utility of mobile devices is allowed, in no small part, by their components and related aspects and features of their function and interoperability. For example, a display component presents graphical information to users; often interactively, with a graphical user interface (GUI) and keyboard, haptic/voice activated and/or other inputs. A battery component comprises an electrochemical power source, which allows mobile devices to operate independently of outside power sources.

Of all mobile device components, the display typically consumes available battery power at the fastest rate and thus, contributes the most significant portion of power drain. During most use time and in most usage scenarios, display related computation remains fairly minor. Where display related computation may intensify, such as when a movie is viewed, increased computational load is typically handled quite efficiently with graphical processor unit (GPU) operations or the function of other dedicated components and circuits. Rather, the power demanded by its backlight subcomponent typically dominates the display's power drain.

An approach to reducing power drain and enhance mobile device effective battery life attempts to produce a visually equivalent image at lower display backlight intensities. For example, a lower power equivalent image version with a dimmed backlight may be rendered using a lightened (e.g., more transparent) liquid crystal display (LCD) subcomponent instance of the image. Equivalence of the low power image instance may thus be maintained, up to a point at which picture elements (e.g., pixels) in the image content may not be rendered without greater lightness or increased backlight emission.

Dynamic range compression (DRC; also referred to as contrast ratio compression) can maintain image instance equivalence beyond the point at which greater lightness or increased power is called for. For example, values stored in a look-up table (LUT) and/or a global or other tone mapping operator (TMO) may be used for DRC. DRC may also allow computation of local tone mapping (and/or color gamut related) changes to be computed over each image portion independently of (e.g., differently than) the other image portions, based on local contrast ratios.

DRC lowers overall dynamic range while preserving most of the image appearance. DRC is also useful for rendering high dynamic range (HDR) imagery and can improve image quality at lower backlight power levels, or can make the display usable with greater amounts of ambient light. However, computing DRC over each pixel of an image based on TMOs adds complexity and latency. In relation to TMO based DRC, LUT based approaches are simple to implement.

While the LUT-based approach may be simpler to implement, it is limited as to how much lightening may be reduced to conserve power before image modifications become visible. For example, excess reduction of backlight illumination for a mobile device flat panel display may cross a threshold related to a just noticeable difference (JND) or another visibility related metric. Thus, the image modification may likely cause an objectionable appearance to a significant number of viewers.

Approaches described in this section could, but have not necessarily been conceived or pursued previously. Unless otherwise indicated, neither approaches described in this section, nor issues identified in relation thereto are to be assumed as recognized in any prior art merely by inclusion therein.

SUMMARY

An example embodiment of the present invention relates to a computer implemented method of processing an image remotely over a network. An electronic device is characterized based on a unique identifier associated therewith and properties data, which relate to display related properties of the device. Local data is collected from the device in relation to real-time conditions and control data and, which correspond to the device in relation to the characterizing. The image is remotely generated for download to the device and includes processing data, which are based on the properties data and the local data.

An example embodiment may be implemented wherein the properties data are collected and associated with the unique identifier.

An example embodiment may be implemented wherein the real-time conditions comprise lighting conditions of an environment of the device.

An example embodiment may be implemented wherein the generated image and the processing data are forwarded to the device. The forwarded image is rendered on the device based on the forwarded processing data, which may comprise controlling a display component of the device. The display component may comprises a backlight sub-component. Thus, the controlling may relate to varying a brightness (e.g., intensity) setting of the backlight sub-component based on the collection of the local data. For example, the display related properties may comprise metadata, which relate to varying (e.g., modulating) the backlight sub-component brightness.

An example embodiment may be implemented wherein the control data may relate to (a) user input(s).

An example embodiment may be implemented wherein the display related properties may relate to optical, electro-optical, photographic, photometric, colorimetric, videographic, and/or cinematic characteristics of the device.

An example embodiment may be implemented wherein a source of the image comprises a server of the network and the mobile device may comprise a first of at least two (2) mobile devices. For example, a number N of mobile devices may communicatively couple with the network and exchange data therewith and the device may comprise one of the N multiple devices. The number N may comprise a positive integer greater than or equal to two (2). Thus, in an example embodiment, the characterization of the device and the collecting of local data are performed in relation to the at least second device. Moreover, the generation of the processing data may be performed based on the collection of local data in relation to the at least second mobile device and its characterization.

An example embodiment of the present invention relates to a computer based system for remotely processing an image. The system comprises a communication network and a mobile device operable for exchanging data over the communication network. The system also comprises a server system for characterizing the mobile device based on a unique identifier associated therewith and properties data, which relate to one or more display related properties of the mobile device. Further, the system comprises a local display data collecting stage for collecting local data from the mobile device in relation to one or more real-time conditions and control data and, which correspond to the device in relation to the characterizing. The system further comprises an image processing stage for remotely generating the image and processing data for download to the mobile device, wherein the processing data are based on the properties data and the local data. The display component of the mobile device is controlled, based on the processing data, to render an instance of the image.

An example embodiment of the present invention relates to an apparatus for displaying an image. For example, the apparatus may comprise a mobile computing device such as a telephone, pad style or laptop computer, personal digital assistant (PDA), camera, video camera/recorder and/or a portable game controller, entertainment console or the like. The apparatus comprises a display component for presenting an instance of a remotely processed image on a mobile device communicatively coupled to a network. The apparatus also comprises a processor and a computer readable memory comprising instructions, which when executed with the processor, cause a method for generating an image. The method comprises, upon communicatively coupling with the network, uploading characterizing data thereto. The characterizing data relate to characterizing the mobile device based on a unique identifier associated therewith and properties data, which relate to one or more display related properties of the mobile device. Upon initiating an image related transaction with the network, local data are collected and uploaded to the network. The local data relate to one or more real-time conditions, and control data and, which correspond to the mobile device in relation to the characterizing. Upon receiving the image and processing data from the network, the display component is controlled based on the properties data. The image is rendered based on the controlling.

The network comprises a server. Upon the initiation of the image related transaction with the network, the image and the processing data are received from the network server. The network server is operable to remotely generate the image and the processing data based on one or more of the properties data or the local data.

An example embodiment may be implemented wherein the mobile device comprises a first of at least two mobile devices. The apparatus may thus comprise a second of the at least two mobile devices. In an example embodiment, the uploading of the characterizing data and/or the collecting and uploading the local data may thus be performed in relation to the at least second mobile device.

It is to be understood that both the foregoing general description and the following somewhat more detailed description are provided by way of example and explanation (and not in any way by limitation) and are intended to provide further explanation of example embodiments of the invention, such as claimed herein.

BRIEF DESCRIPTION OF THE DRAWINGS

The accompanying drawings below comprise a part of the specification herein of example embodiments of the present invention and are used for explaining features, elements and attributes thereof. Principles of example embodiments are described herein in relation to each figure of these drawings, in which like numbers are used to reference like items, and in which.

DESCRIPTION OF EXAMPLE EMBODIMENTS

Example embodiments of the present invention are described herein in the context of and in relation to remote display rendering for electronic devices. Reference will now be made in detail to implementations of the example embodiments as illustrated in the accompanying drawings. The same reference numbers will be used to the extent possible throughout the drawings and the following description to refer to the same or like items. It will be apparent to artisans of ordinary skill in technologies that relate to imaging, displays, networks, computers and mobile devices however, that example embodiments of the present invention may be practiced without some of these specifically described details.

For focus, clarity and brevity, as well as to avoid unnecessarily occluding, obscuring, obstructing or obfuscating features that may be somewhat more germane to, or significant in explaining example embodiments of the present invention, this description may avoid describing some well-known processes, structures, components and devices in exhaustive detail. Ordinarily skilled artisans in these technologies should realize that the following description is made for purposes of explanation and illustration and is not intended to be limiting in any way. Other embodiments should readily suggest themselves to artisans of such skill in relation to the features and corresponding benefit of this disclosure. An example embodiment of the present invention is described in relation to remote display rendering for mobile devices.

An example embodiment of the present invention relates to a computer implemented method of processing an image remotely over a network. An electronic device is characterized based on a unique identifier associated therewith and properties data, which relate to display related properties of the device. Local data is collected from the device in relation to real-time conditions and control data and, which correspond to the device in relation to the characterizing. The image is remotely generated for download to the device and includes processing data, which are based on the properties data and the local data.

Figure 1:
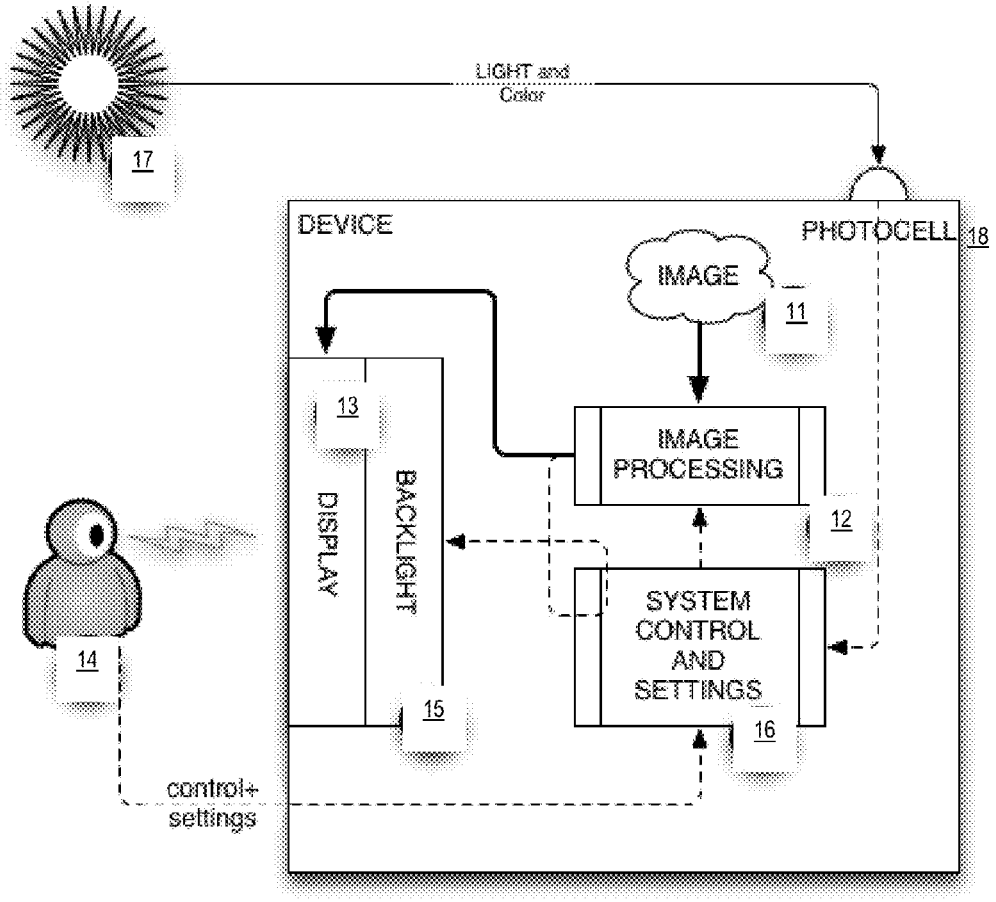
FIG. 1 depicts a typical mobile device display control system, with which an embodiment of the present invention may function.

FIG. 1 depicts a typical mobile device display control system 10, with which an embodiment of the present invention may function. An image 11, e.g., captured or being rendered with the mobile device 10, is modified by image processing 12 before being displayed by display 13 and seen by the user 14. Display 13 is illuminated by its backlight subcomponent 15, which can be controlled by processing 12 according to content characteristics (e.g., pixel luma or luminance and/or chroma or chrominance) of the image 11.

User 14 may set controls and settings 16 to enable or disable the dynamic display dimming or parameters associated therewith, such as maximum tolerable image loss (e.g., aggressiveness). System 10 can also be adaptive to the ambient illumination 17, as detected with a photocell or similar sensor 18, so that the same techniques can be used to show acceptable images in high amounts with ambient illumination. However, power savings may be sacrificed to achieve acceptable image rendering in high ambient light milieu.

An embodiment of the present invention saves power in mobile devices and improves the quality of images rendered therewith using remote processing of the images. An example embodiment may be implemented wherein the processing is performed in a network such as a wide area network (WAN) or distributed over a communicatively coupled group of networks such as the internet or a cloud network, e.g., a network as a service (NaaS). For example, an embodiment may be implemented wherein the processing is performed on a server or in a system of servers.

The images themselves may comprise image or video content that is sent to the mobile device and viewed therewith, e.g., from a remote server associated with the network. The images may also (or alternatively) comprise image or video content that is captured with the mobile device, e.g., with a camera apparatus, component or functionality thereof.

An example embodiment leverages the significant degree to which image and video content viewed, which is viewed in mobile devices (but not captured therewith), is created remotely and streamed or otherwise sent to the device for real time playback (or still picture display). For example, mobile devices allow users to participate in network based (e.g., online) games and to view movies streaming from services like Netflix™ that prevent, inhibit or do not allow local storage or caching of the image content. For image content including still images (e.g., photographs), video and movies from such online services, an embodiment is implemented wherein image processing and modifications are applied to the image content in the network server, before the content is streamed.

An embodiment may be implemented wherein the server processes and modifies the image content based on ambient illumination (e.g., brightness and color) sensed in local proximity to the mobile device, user settings applied to the mobile device, system calibration and other information that relate to the mobile device. These data are uploaded from the mobile viewing devices to the server via the network.

Ambient light levels sensed at a mobile device and user controls thereto typically change somewhat slowly over time. Thus, an example embodiment encodes the ambient light levels and user settings economically in relation to data usage and bandwidth.

Moreover, frame rates associated with online games and video streams are typically high and, an example embodiment synchronizes modifications to backlight levels, used in improving image appearance, with the remote image changes. Thus, latency that may be added by the server side rendering remains substantially imperceptible.

An example embodiment may thus function with other content that is generated remotely and viewed locally, such as remote desktops from Splashtop™. An example embodiment synchronizes the remote image rendering with the local backlight adjustment and may thus lower power use and/or improve the quality of an image displayed on a mobile device over a variety of online viewing scenarios.

Moreover, an example embodiment may be implemented wherein remote image rendering for mobile devices extends to aspects of the display that include color, gamma and/or linearization adjustment or correction (e.g., with RGB content for displays that use XYZ, YCbCr or other non-sRGB compliant color spaces), scaling, sharpening, persistence-of-vision (POV) rendering and other aspects.

An example embodiment may be implemented wherein a mobile device is characterized. Characterizing the device allows remote processing to consider specific device properties. For instance, a mobile device with a non-sRGB display may correctly output RGB image content, where the server pre-modifies the content to account for the specific device display's non-sRGB colorimetry. Characterization may be omitted, optional or performed initially or occasionally, or may be performed regularly.

Figure 2:
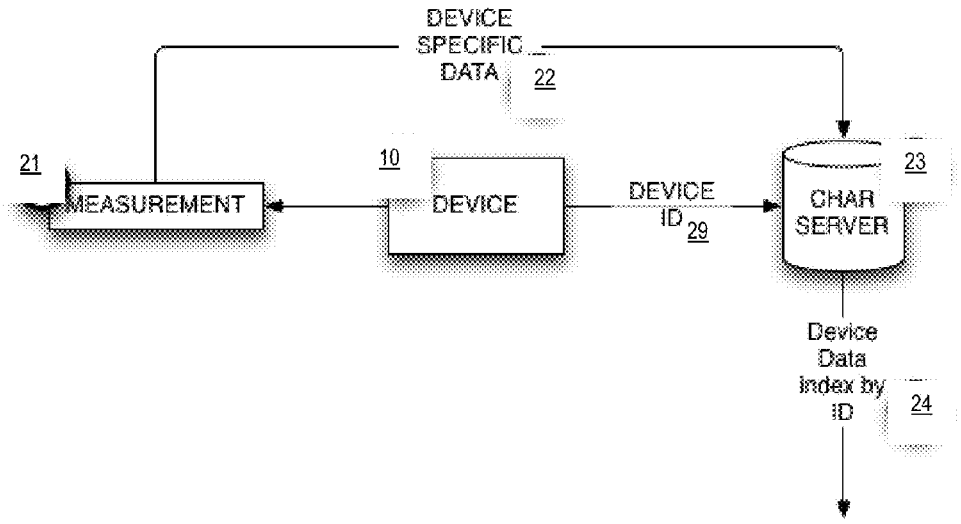
FIG. 2 depicts an example mobile device characterization stage, according to an embodiment of the present invention.

FIG. 2 depicts an example mobile device characterization mobile device characterization stage 20, according to an embodiment of the present invention Performance characteristics and design attributes 21 of a mobile device 10 may be measured upon original design, bring-up or factory assembly, calibration or repair, or an action or update initiated by a user or agent.

These characteristic data 21 may be gathered using laboratory or special instrumentation such as spectro-radiometers, colorimeters and the like. An example embodiment may be implemented wherein particular users or groups of users are identified and like devices, e.g., same make, model and version, are characterized thereafter. An example embodiment may be implemented wherein every mobile device is characterized upon manufacture or issue, e.g., at the factory.

The device specific data 22 are stored along with an identifier (ID) 29, which identifies a mobile device uniquely on a characterization database and/or server 23, as indexed device data 24. Device data 24 is available for access and subsequent retrieval, e.g., as called for image processing.

Upon its characterization, the same device 10 (or another instance of a like device model), may be used to display an image that is generated or processed remotely. For example, mobile device 10 may display a frame for an online video game, a frame for streaming movie, or a still image such as a photograph or graphic that is generated or processed (e.g., and/or modified, transcoded or altered) remotely. An example embodiment may be implemented wherein mobile device 10 also displays an image or video frame that it generates or captures locally, e.g., with a camera or video recording feature or component thereof, and wherein the image it displays is processed remotely.

Figure 3:
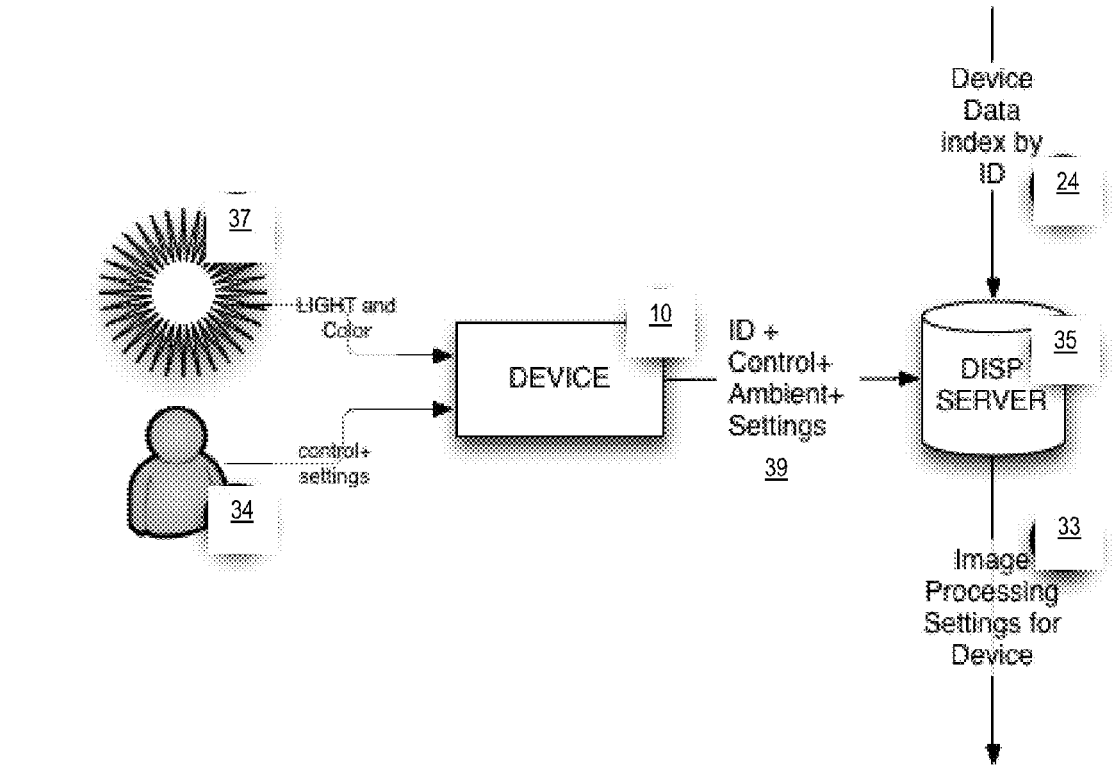
FIG. 3 depicts an example control input stage, according to an embodiment of the present invention.

FIG. 3 depicts an example control input stage 30, according to an embodiment of the present invention. Information input 37 relates to the ambient light conditions 37 and may be gathered by a sensor such as photocell 18 (FIG. 1). Information input 34 relates to user settings (e.g., user settings 16; FIG. 1), such as photographic application settings, joystick game commands, etc. Information input 34 and 37 are uploaded, e.g., in a small, thin or light data format, along with specific device identification related data (e.g., ID data 24; FIG. 2), which may include a model number, a serial number, or a globally unique identifier (GUID) in ID, control and ambient settings 39. These data are gathered by device 10 and sent to a remote display processor, display database and/or display server 35 and associated with the device based on the unique identifier.

Remote processor/server 35 organizes the image processing by fetching the correct device characterization 24. Remote processor 35 prepares and makes accessible or exports image processing settings 33, which relate to optimizing the display characteristics of mobile device 10 based on ID, control and ambient settings 39, which are based in turn, e.g., on data input 34 and data input 37.

Figure 4:
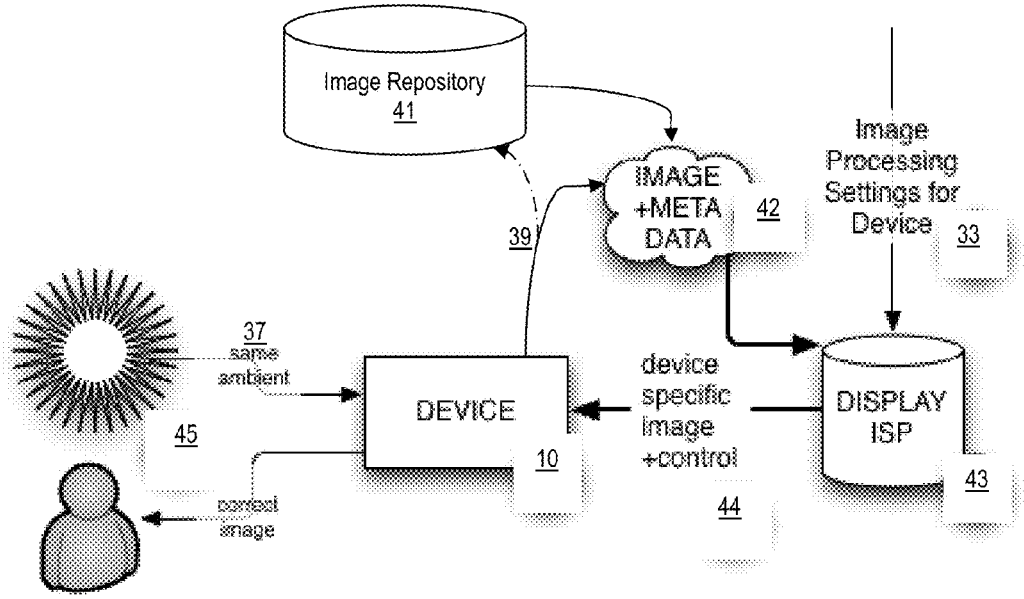
FIG. 4 depicts an example image output stage, according to an embodiment of the present invention.

FIG. 4 depicts an example image output stage 40, according to an embodiment of the present invention. The settings 33 (generated e.g., per FIG. 3) are used by a display image signal processor (ISP) 43 to process an image 42. Image 42 may comprise an image instance that is accessed, streamed, sent or transmitted \ from a remote image database or other image repository 41. Image 42 may also comprise an image instance that is uploaded from device 10 for remote processing with one or more of image repository 41, using metadata 39 uploaded with the image therefrom, or ISP 43. Image 42 comprises image content and the associated metadata 39, which ISP 43 processes so as to render a new image instance 44.

New image instance 44 comprises image processing output data that has control settings corresponding thereto, which relate to the backlight intensity and/or other commands or data specifically tailored to device 10 at that moment in time with the ambient lighting milieu 37 (e.g., FIG. 3), to display an output image 45 therewith. The display of device 10 thus presents the output image 45 to the user with corrections and other processing thereto. These corrections optimize the image in real time (or effectively so in near real time) under the then temporally current light condition 37.

An example embodiment provides for interruptions or pauses of video content and other image streams. For instance, upon an interruption in an image stream, an example embodiment is implemented wherein the last available instance of image 44 may be processed or modified further, as may optimize its appearance in then current ambient light 37. In an example embodiment, local logic components of device 10 may exert control over the backlight of its display as described with reference to FIG. 1 above, to provide a perceptually seamless experience for its users despite a stream interruption. Not dissimilarly, in the case wherein the stream was paused, an example embodiment is implemented wherein a full range frame is sent to be manipulated by device 10 local logic until the stream resumes.

Example embodiments are described herein in relation to display of videos, images and game content for simplicity, brevity and clarity and not in any way to imply or express a limitation thereto. On the contrary: example embodiments are well suited to provide utility over a wide spectrum and deep variety of interactive remote viewing sessions, including (but not limited to) browsing, remote desktops, applications, games, photography, video, cinema, and graphics. An example embodiment may be implemented in relation to a system that comprises, in addition to output stage 40, one or more elements, components or features, which are described above with reference to characterization feature 20 (FIG. 2) and/or input stage 30 (FIG. 3).

Figure 5:
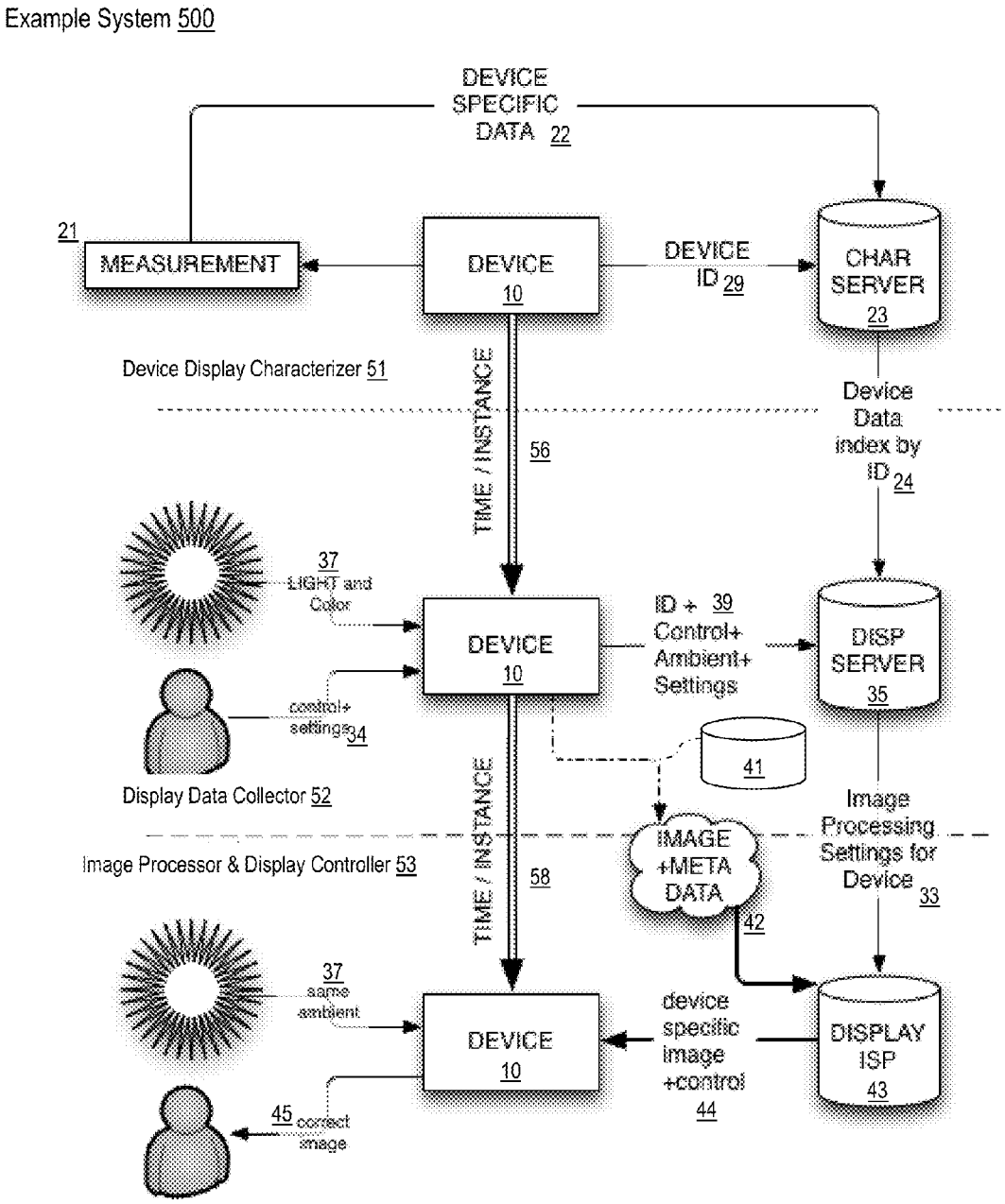
FIG. 5 depicts an example computer and/or network based system for remote display rendering for mobile devices, according to an example embodiment of the present invention.

FIG. 5 depicts an example computer and/or network based system 500 for remote display rendering for mobile devices, according to an example embodiment of the present invention. An example embodiment may be implemented wherein measurement feature 21 and device characteristic server 23 respectively gather and store/serve data 22, which is specific to device 10 and thus comprise a device display characterizer 51. In an example embodiment, measurement feature 21 may function individually or uniquely with respect to device 10. An example embodiment may thus be implemented wherein measurement feature 21 functions upon device 10's design, prototyping, assembly, calibration and/or repair, and wherein measurement function 21 functions or is performed once, other than regularly, other than in real time or near real time (e.g., in relation to subsequent image capture, processing, rendering or display functions), or occasionally.

In an example embodiment, the measurement 21 and/or rendering and storage of device specific data 22 corresponds to or is recorded at or in relation to a temporally and/or contextually relevant time/instance 56. Device characteristic server 23 outputs device data 24, which is indexed according to an identifier such as a serial number, model number or the like, or otherwise makes device specific data 24 available to other components of system 500. Device specific data 24 may comprise data related to time/instance 56, such as a time stamp and/or metadata or other descriptors, tags, flags or links related to context, e.g., that may be relevant thereto. Device data 24 is accessible, e.g., available, sent, streamed or transmitted to other components of system 500.

An example embodiment may be implemented wherein display server 35 receives or accesses data 24, which is uniquely indexed by an identifier of device 10, and identity/control settings 39 from device 10, which comprise light and color data 37 that has current relevance to time/instance 58. Display server 35 computes processing over data 24 and settings 39 to output image processing settings 33 for device 10, which are relevant to time/instance 58. Thus at time/instance 58, during which image 42 may be streamed as video content to device 10 from image repository 41 (or captured/uploaded from device 10), display server 35 and device 10 function together too perform image data collection 52. Display server 35 may receive, access or collect device specific data 24 on a function on an access, pull or demand (e.g., by device 10) basis or occasionally and/or periodically be updated therewith, e.g., on a push, subscription or not dissimilar basis.

On a push basis for example, device data 24 may change, e.g., dynamically and/or based on a passage of time relative to time/instance 56 and/or time/instance 58. Upon changing, device data may be pushed or upon, e.g., crawling, collection, indexing, storage, access, linking or query request, updated data 24 may be pushed or pulled to display server 35. Moreover, display server 35 may receive, access or collect device specific data 24 upon an access, query or demand (e.g., by device 10) basis or occasionally and/or periodically. Display processing and data collector 52 may thus function to update display server 35*d* therewith, e.g., on the push, a subscription or not dissimilar basis.

An example embodiment may be implemented wherein image 42, which comprises content streamed from image repository 41 or uploaded from device 10 with metadata (e.g., metadata 39; FIG. 3), which has relevance to time/instance 58. Time/instance 58 and time instance 56 may be independent. For example, light and color data 37 may be captured locally or proximately in relation to device 10 at time/instance 58, which may thus represent a time and context corresponding to the capture, upload and/or streaming of image instance 42.

The metadata may also comprise light and color information for reproducing, rendering and displaying an image on device 10 or various other devices in such a way as to preserve a scenic intent. For example, a film director may capture an original instance of the image certain light and color conditions. In this case, the director may have an artistic intent to render that scene as closely as possible to the captured scene for as many types or models that device 10 and display components thereof may reproduce. The metadata may also comprise motion vectors, codec (compression/decompression, etc.) and/or scalability information. Scalability data may function to optimize rendering image 42 for display over a wide variety of devices as in the Scalable Video Codec (SVC) extension to the H.264/MPEG4 codec.

Data 37 may be gathered or captured by photocell 18 (FIG. 1) or an analogous electro-optical sensor component of device 10. Thus, photocell 10 may represent herein any photosensitive or optical sensor such as a charge coupled device (CCD), photodiode or any of a variety of detectors that work with quantum based effects and useful detection sensitivities.

In contrast, measurement 21 may be performed at time/instance 56. In this example, time/instance 56 thus represents a time that may be significantly earlier than that of time/instance 58 and in a context that relates to factory or laboratory data collection. Additionally and/or alternatively, time/instance 58 and time instance 56 may each comprise the same time and/or context. Thus, an example embodiment may be implemented wherein measurement 21 is collected contemporaneously, simultaneously or in real time or near real time in relation to capture, upload and/or streaming of image instance 42. In this example, measurement 21 may be gathered by photocell 18. Further, measurement 21 may comprise additional data gathered by laboratory or factory instrumentation, with which data gathered by photocell component 18 may be compared, calibrated and/or adjusted.

An example embodiment may be implemented wherein display ISP 43 receives or accesses image 42 and image processing settings 33 for device 10. Image 42 may be streamed, sent or transmitted to ISP 43 by imaged repository 41 or uploaded directly thereto by device 10 or an intermediary repository (e.g., 41). Display ISP 43 performs server side image processing over image 42 based on its metadata and importantly, based on image processing settings 33 for device 10. Based on the server side processing, display ISP 43 renders an image instance 44 that comprises an instance of image 42 and settings or commands, which exert control over the backlight unit of device 10's display (e.g., backlight unit 15, display 13; FIG. 1). Image instance 44 and its control settings are specifically optimized for presentation with the display of device 10 under light conditions 37, which remain then current in relation to time/instance 58. In an example embodiment, display ISP 43 thus functions as a remote image processor and display controller 53 over device 10.

An example embodiment may thus be implemented wherein display data collector 52 and remote image processor/display controller 53 function together to remotely process images and data for mobile device 10. In an example embodiment, remote image processing system 500 further comprises device display characterizer 51.

An example embodiment may thus be implemented wherein image repository 41 comprises a non-transitory (e.g., tangible) data storage entity such as may be associated with a Web based service such as Google Images™, an image and video database or data warehouse, such as may be associated with streaming content from a server, multiple servers or a server farm such as streaming services such as Netflix™ or YouTube™ and/or within a network, NaaS or cloud based infrastructure, platform, configuration or geometry. An example embodiment may thus be implemented remote rendering system 500 is disposed within or deployed upon, or comprises a feature, function or element of a network based platform (e.g., network, infrastructure, environment, milieu, backbone, architecture, system, database) and/or a network/cloud based platform.

Figure 6:
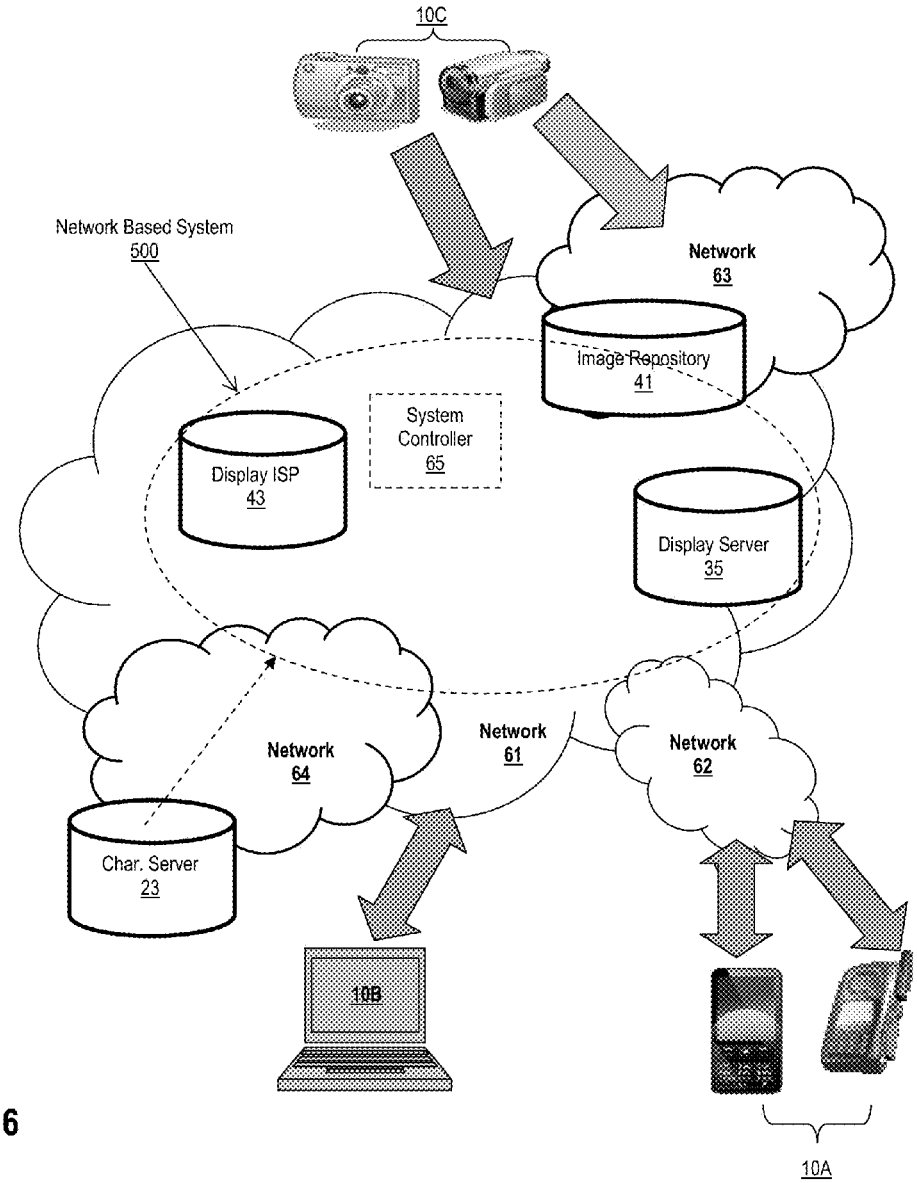
FIG. 6 depicts an example computer based remote rendering system and network/cloud based platform.

FIG. 6 depicts example remote rendering system 500 and an example network/cloud based platform 600, according to an embodiment of the present invention. An example embodiment is implemented wherein system 500 comprises a network based functionality, which is disposed in, distributed over, communicatively coupled through and/or exchanging data with one or more components (e.g., features, elements) of network platform 600.

Network/cloud based platform 600 is represented herein with reference to an example first network 61, an example second network 62, an example third network 63 and an example fourth network 64. It should be appreciated that any number of networks may comprise components of network/cloud platform 600. One or more of networks 61-64, inclusive, represents a network that provides communication, computing, data exchange and processing, image, video, music, movie, online game related and/or data streaming, NaaS and/or other cloud-based network services. One or more of the network of platform 600 may comprise a packet switched network. For example, platform 600 may comprise one or more packet switched WANs and/or the Internet.

Device instances 10A, 10B and 100 may represent any number, model and type of device 10, which may be accommodated for communication and data exchange with system 500 and network/cloud platform 600. Example device instances 10A may represent cellular telephones, smart phones, pad computers, personal digital assistants (PDA) or the like. Devices 10A may communicatively couple and exchange data with features and elements of network/cloud based platform 600 and/or remote processing system 500 via network 62, which may comprise a wireless (e.g., and/or wire line) telephone network, or via network 61 or another network of platform 600.

Example device instance 10B may represent personal computers (PCs), workstations, laptops, pad computers, or other computer devices, communicating devices, calculators, telephones or other devices. Example device instances 100 may represent cameras, video camera-recorders, cell phone or smart phone based cameras or the like. Device instances 10B and 100 may communicatively couple and exchange data with features and elements of network/cloud based platform 600 and/or remote processing system 500 via network 61, network 62, or another network of platform 600.

The networks of image platform 600 comprise hardware, such as may include servers, routers, switches and entities for storing, retrieving, accessing and processing data. Features, elements, components and functions of remote processing system 500 may be disposed within, distributed over or function with these hardware. Thus, image repository 41 may function for example within, or be accessible through network 63, which may be associated with a streaming service.

Display server 35 and/or display ISP 43 may function with, or be accessible through network 61, or through another network of platform 600. Or for example, device characteristic server 23 may function within, or be accessible through network 64, which may be a wireless and/or wire line local area network (LAN), WAN or another network, database or application associated with a factory or laboratory that designs, develops, tests, manufactures, assembles and/or calibrates one or more of device instances 10A, 10B or 100. In an example embodiment, system 500 comprises device characteristic server 23 and/or network 64, which may thus also be controlled, programmed or configured with system controller 65. For example, controller 65 may represent a switching and/or routing hub for a wireless telephone network, another communication entity or a computing or database entity.

An example embodiment may be implemented wherein system controller 65 controls, coordinates, synchronizes and sequences system 500 and/or the remote processing of images therewith. An example embodiment may be implemented wherein system controller 65 controls, coordinates, synchronizes and sequences platform 600, or the networking and intercommunication between two or more of the networks, components, elements, features and functions thereof, such as to achieve or promote remote processing of images therewith.

Image 42 may be streamed to device instance 10A, 10B and/or 100 from image repository 41 (or one or more of the other device instances) for remote processing with system 500 and/or network platform 600. Image 42 may also, optionally or alternatively be uploaded from one or more of devices 10A, 10B and 100 for remote processing with system 500 and/or network platform 600.

One or more of image repository 41, characteristic server 23, display server 35 and/or display ISP 43 may comprise one or more physical and/or logical instances of a server, processor, computer, database, production or post-processing facility, image repository, server farm, data warehouse, storage area network (SAN), network area storage (NAS), or a business intelligence (BI) or other data library. One or more of the networks of platform 600 may comprise one or more physical and/or logical instances of a router, switch (e.g., for packet-switched data), server, processor, computer, database, image repository, production or post-processing facility, server farm, data warehouse, SAN, NAS or BI or other data library.

System 500 and/or network platform 600 remotely process images streamed to, or uploaded from one or more of device instances 10A-100, inclusive. Device instances 10A-100, inclusive, represent any number of instances of a mobile device 10. Network 61 and one or more of networks 62-64, inclusive, of network platform 600 represent any number, configuration or geometry of communication, packet switched, computing, imaging, and/or data exchange networks.

One or more of the instances 10A, 10B and 10C of mobile device 10 may upload locally captured instances of image content somewhat more frequently than they may receive or access remotely processed mages. For example, device instance 100 may be associated with apparatus such as a digital camera or a video camcorder (camera/recorder), which is designed to record images to a degree that is somewhat more significant thereto than, e.g., receiving streamed images from network 61 network 63, etc. For an example contrast, images may be streamed through network/cloud platform 600 more frequently, and with more significant remote processing therein, from image depository 41 to device instance 10A or to device instance 10B. Device instance 10B may also download one or more instances of image 42 from a particular instance of device 10A, or of device 100.

System 500 and network/cloud platform 600 function together to provide remote image processing in various configurations, scenarios and applications. For example, the remote processing optimizes streaming or uploaded instances of image 42 for rendering or presentation with the display components of two or more instances of device 10 (e.g., devices 10A, 10B and/or 100). As the various device instances may be located at different geographical locations, they may have (e.g., be set in) different or independent time zones, meteorological, astronomical or other conditions. Thus, light/color conditions 37 (FIGS. 3, 4, and 5) may differ for rendering optimally each of the instances, as well.

However, an embodiment is implemented wherein the light conditions 37 of each device instance are measured or sampled independently in relation to each other; e.g., with their individual photocells 10 (FIG. 1). One or more physical or logical instances of character server 23 may store, index, catalog, file and provide access independently to individual instances of device data 22 and device identifier 29, each of which corresponds uniquely to one of devices 10A, 10B or 100.

One or more physical or logical instances of display server 35 may store, index, catalog, file, process, update and provide access independently to individual instances of device identified control and ambient settings 39, each of which corresponds uniquely to one of devices 10A, 10B or 100 at each time/instance 58 and thus, to the specific light conditions 37 independently measured/sampled therewith. Moreover, display ISP 43 remotely processes instances of image 42 uploaded from one or more of the device instances 10A, 10B or 100 or streamed from image repository 41 based, at least in part, on each of the devices' light/color data 37 and settings 34, which are gathered or collected locally in relation each thereto at each time/instance 58. Thus, one or more physical or logical instances of display ISP 43 may render independent instances of image 42 and corresponding image control settings 44 for rendering image instance optimally at each individual device instance 10A, 10B and 10C.

System 500 and/or network/cloud platform 600 may represent remote image processing for various applications, scenarios and situations. For example, system 500 and network/cloud platform 600 may represent a remote image processing platform for typical individual, commercial and industrial users, such as in a home, business or school. However, system 500 and network/cloud platform 600 may represent a more specialized or sophisticated remote image processing platform.

An implementation of an example embodiment may thus be represented wherein system 500 and network 600 relate to video, cinematic or photographic production. Devices 10C may thus represent one or more cameras, which perhaps provide more image frames to network 600 than remotely processed frames that they receive therefrom. The operation of the camera devices 100 may thus be coordinated or controlled by lighting technicians and engineers, who may use devices 10A to view remotely processed instances of the images captured with devices 100. In fact, one instance of device 10A may display an image instance that is rendered optimally for the ambient associated with devices 10A and another instance of device 10A may display an image instance that is rendered optimally for the ambient associated with devices 100. A director may use device 10B, which may render either or both image instances, or which may provide color timing or other inputs, with which to control or affect remote processing in display ISP 43.

An implementation of an example embodiment may thus be represented wherein system 500 and network 600 relate to a medical application. One of device instances 100 may thus represent medical imagers, for example a hospital based imager for X-Ray, CT (computerized tomography), MRI (magnetic resonance imager), ultrasound or nuclear diagnostics such as a PET (positron emission tomography) scanner. Another instance of device instance 100 may be deployed by an emergency medical asset such as an ambulance, a remote clinic or a military combat medicine unit. The operation of the imager device instances 100 may thus be coordinated or controlled by a physician or surgeon, who may use device instances 10A to view remotely processed instances of the images captured with each of device instances 100. An instance of device 10A may thus display an image instance gathered by one or more of device instances 100, but processed remotely so as to render that image instance with control settings 44 for optimal display 45 in the current local light conditions 37 and settings 34 local to each of device instances 10A. Contemporaneously, consulting physicians and/or surgeons may view an independently remotely processed and rendered instance of that image with control settings 44 for optimal display 45 in the current local light conditions 37 and user settings 34 local to each of device instances 10B.

An implementation of an example embodiment may thus be represented wherein system 500 and network 600 relate to a military application. Device instances 100 may thus represent cameras, for example one on a manned or unmanned aircraft or reconnaissance satellite and another deployed by a forward combat asset such as a special warfare operative or an artillery observer or forward air controller. The operation of the camera devices 100 may thus be coordinated or controlled by field, company, platoon commanders or squad leaders, who may use devices 10A to view remotely processed instances of the images captured with devices 100. An instance of device 10A may thus display an image instance gathered by one or more of device instances 100, but processed remotely so as to render that image instance with control settings 44 for optimal display 45 in the current local light conditions 37 and settings 34 local to each of device instances 10A. Contemporaneously, a battlefield or battalion commander may view an independently remotely processed and rendered instance of that image with control settings 44 for optimal display 45 in the current local light conditions 37 and user settings 34 local to each of device instances 10B.

Thus, an example embodiment may be implemented wherein remote processing is provided for multiple mobile devices 10 independently, and based on each of the devices' control settings and corresponding ambient light/color conditions and user settings.

An example embodiment of the present invention may thus relate to a computer based system for remotely processing an image. The system comprises a communication network and a mobile device operable for exchanging data over the communication network. The system also comprises a server system for characterizing the mobile device based on a unique identifier associated therewith and properties data, which relate to one or more display related properties of the mobile device.

Further, the system comprises a local display data collecting stage for collecting local data from the mobile device in relation to one or more real-time conditions and control data and, which correspond to the device in relation to the characterizing. The system further comprises an image processing stage for remotely generating the image and processing data for download to the mobile device, wherein the processing data are based on the properties data and the local data. The display component of the mobile device is controlled, based on the processing data, to render an instance of the image.

Moreover device 6A, 6B and/or 6B may comprise an apparatus. For example, an embodiment of the present invention relates to an apparatus for displaying an image. The apparatus may comprise a mobile computing device such as a telephone, pad style or laptop computer, personal digital assistant (PDA), camera, video camera/recorder and/or a portable game controller, entertainment console or the like.

The apparatus comprises a display component for presenting an instance of a remotely processed image on a mobile device communicatively coupled to a network. The apparatus also comprises a processor and a computer readable memory comprising instructions, which when executed with the processor, cause a method for generating an image.

In an example embodiment, the method comprises uploading characterizing data to a network upon communicatively coupling thereto. The characterizing data relate to characterizing the mobile device based on a unique identifier associated therewith and properties data, which relate to one or more display related properties of the mobile device. Upon initiating an image related transaction with the network, local data are collected and uploaded to the network. The local data relate to one or more real-time conditions, and control data and, which correspond to the mobile device in relation to the characterizing. Upon receiving the image and processing data from the network, the display component is controlled based on the properties data. The image is rendered based on the controlling.

Figure 7:
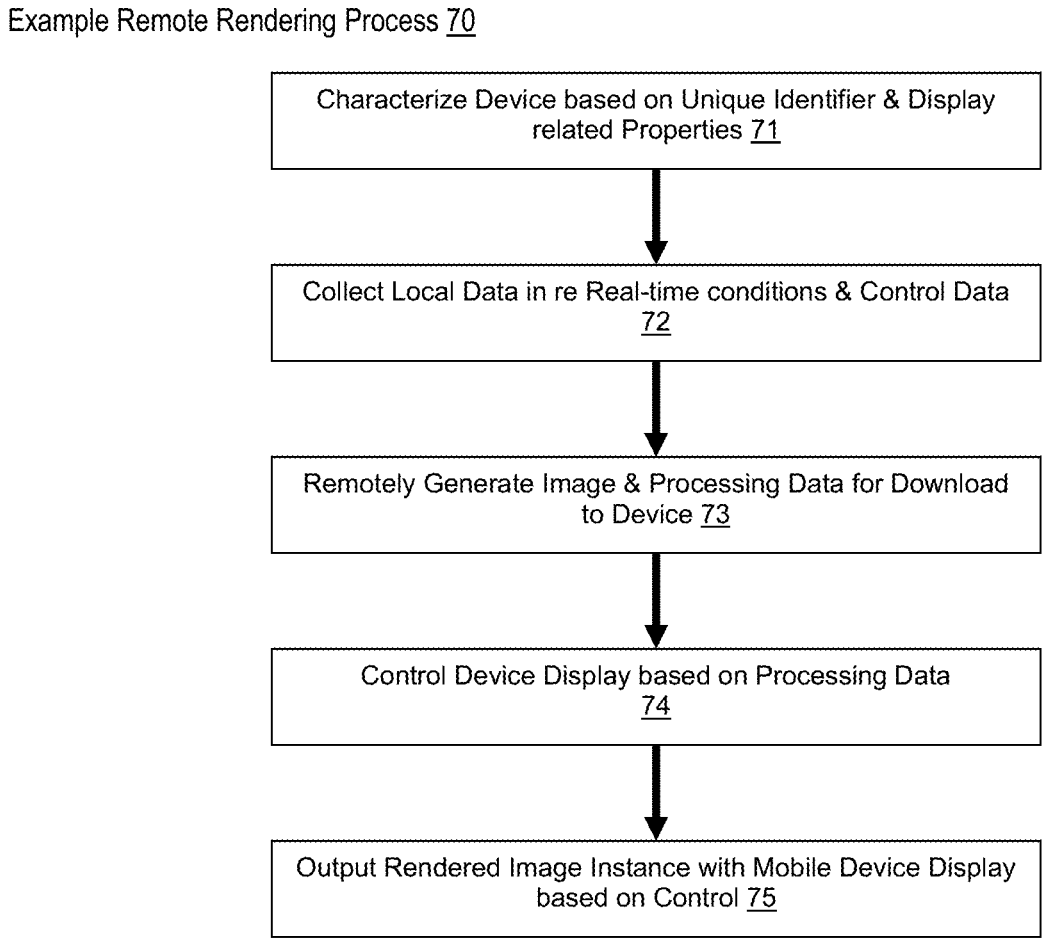
FIG. 7 depicts a flowchart for an example computer implemented process, according to an embodiment of the present invention.

FIG. 7 depicts a flowchart for an example computer implemented and/or network based process 70, according to an embodiment of the present invention. A mobile device is characterized (71). For example, upon inputting or determining its identity, optical and/or photographic characteristics of the device are determined and stored according to an identifier of the device, such as a unique identifier, model or type. Characterization 71 may comprise a function of the network or an initial or other input thereto.

Real-time data that correspond to an environment of the device and control settings (e.g., user inputs) are collected (72). The real-time data may be based, for example, on ambient light and color conditions and user settings local to the device, The collected local data and control data may be stored in correspondence with the identity and characteristics of the device.

An image and related processing data are generated remotely for download to the device (73). Such remote processing may be performed over a streaming or uploaded image based on the local data and control data.

A display component of the device is controlled (74) based on the processing data. The display component of the device may output a rendered instance of the image (75) based on such control.

An example embodiment of the present invention thus relates to a computer implemented method (70) of processing an image remotely over a network. An electronic device is characterized based on a unique identifier associated therewith and properties data, which relate to display related properties of the device. Local data is collected from the device in relation to real-time conditions and control data and, which correspond to the device in relation to the characterizing. The image is remotely generated for download to the device and includes processing data, which are based on the properties data and the local data.

An input display setting, based for example on ambient light and color conditions and user settings local to the device, are input (72) in correspondence with the identity and characteristics of the device. Remote processing is performed (73) over a streaming or uploaded image based on the input display settings, wherein control data settings are added to an image stream and sent (74) to the mobile device.

Upon receiving or accessing the streamed or uploaded image and control settings, the mobile device outputs (75) the remotely processed rendered image with its component display component. The backlight unit of the device display component is controlled so as to optimize the output display for light and/or color conditions, then current locally in relation to the mobile device.

An example embodiment may be implemented wherein the properties data are collected and associated with the unique identifier.

An example embodiment may be implemented wherein the real-time conditions comprise lighting conditions of an environment of the device.

An example embodiment may be implemented wherein the generated image and the processing data are forwarded to the device. The forwarded image is rendered on the device based on the forwarded processing data, which may comprise controlling a display component of the device. The display component may comprises a backlight sub-component. Thus, the controlling may relate to varying a brightness (e.g., intensity) setting of the backlight sub-component based on the collection of the local data. For example, the display related properties may comprise metadata, which relate to varying (e.g., modulating) the backlight sub-component brightness.

An example embodiment may be implemented wherein the control data may relate to one or more user inputs.

An example embodiment may be implemented wherein the display related properties may relate to optical, electro-optical, photographic, photometric, colorimetric, videographic, and/or cinematic characteristics of the device.

An example embodiment may be implemented wherein a source of the image comprises a server of the network and the mobile device may comprise a first of at least two (2) mobile devices. For example, a number N of mobile devices may communicatively couple with the network and exchange data therewith and the device may comprise one of the N multiple devices. The number N may comprise a positive integer greater than or equal to two (2).

Thus, in an example embodiment, the characterization of the device and the collecting of local data are performed in relation to the at least second device. Moreover, the generation of the processing data may be performed based on the collection of local data in relation to the at least second mobile device and its characterization.

Example embodiments of the present invention are thus described in relation to remote display rendering for mobile devices. An example embodiment of the present invention thus remotely processes an image over a network, to be rendered with a display component of a mobile device communicatively coupled to the network.

Example embodiments are described in relation to remote display rendering for mobile devices. In the foregoing specification, example embodiments of the present invention are described with reference to numerous specific details that may vary between implementations. Thus, the sole and exclusive indicator of that, which embodies the invention, and is intended by the Applicants to comprise an embodiment thereof, is the set of claims that issue from this application, in the specific form in which such claims issue, including any subsequent correction.

Definitions that are expressly set forth in each or any claim specifically or by way of example herein, for terms contained in relation to features of such claims are intended to govern the meaning of such terms. Thus, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A computer implemented method of rendering an image over a network, the method comprising:

accessing characterization data with respect to display properties of an electronic device based on an identifier associated with the electronic device, wherein the display properties comprise display capabilities of the electronic device and are independent of content displayed by the electronic device, wherein the characterization data is updated to a storage device periodically;

collecting local data from the electronic device over the network wherein the local data represents a real-time ambient condition and control data, wherein the control data relates to real-time user input to the electronic device with respect to a control setting of the electronic device; and remotely generating image data and processing data for download to the electronic device based on the characterization data and the local data.

2. The method as recited in claim 1, further comprising collecting the characterization data from the electronic device and associating the characterization data with the identifier.

3. The method as recited in claim 1 wherein the real-time ambient condition comprises a lighting condition surrounding the electronic device.

4. The method as recited in claim 1, further comprising:

remotely determining a display control setting based on the characterization data and the local data of the electronic device:

transmitting the image data and the display control setting to the electronic device, and remotely rendering the image data for display on a display device coupled to the electronic device based on the display control setting.

5. The method as recited in claim 4 wherein the remotely rendering comprises controlling a display parameter of the display device based on the display control setting.

6. The method as recited in claim 5 wherein the controlling the display parameter comprises adjusting a backlight sub-component of the display device to vary a brightness of the backlight sub-component.

7. The method as recited in claim 6 wherein the display control setting is transmitted to the electronic device as metadata, which relates to varying the backlight sub-component brightness.

8. The method as recited in claim 1 wherein the display properties relate to one or more optical, electro-optical, photographic, photometric, colorimetric, videographic, and cinematic characteristics of the electronic device.

9. The method as recited in claim 1 wherein the image data represents video content operable to be streamed from a server to the electronic device.

10. The method as recited in claim 9 wherein the electronic device comprises a mobile computing device, and wherein the identifier corresponds to a model number of the mobile computing device.

11. The method as recited in claim 1 further comprising remotely generating image data for rendering on another electronic device based on the characterization data and the local data of the electronic device.

12. A system comprising:

a processor;

network circuitry coupled to the processor;

memory coupled to the processor and storing instructions that, when executed by the processor, cause the system to perform a method of:

accessing characterization data with respect to display properties of an electronic device based on an identifier associated with the electronic device, wherein the display properties comprise display capabilities of the electronic device and are independent of content displayed by the electronic device, wherein the characterization data is updated periodically;

collecting local data from the electronic device over a network, wherein the local data represents a real-time ambient condition and control data, wherein the control data relates to real-time user input to the electronic device with respect to a control setting of the electronic device; and remotely generating image data and processing data for download to the electronic device based on the characterization data and the local data.

13. The system as recited in claim 12 wherein the real-time condition comprises a local lighting condition of an environment of the electronic device.

14. The system as recited in claim 12 wherein the method further comprises streaming the image data to the electronic device through the network.

15. The system as recited in claim 12 wherein the generating the image data comprises: receiving a source image uploaded from the electronic device; and processing the source image based on the characterization data and the local data.

16. The system as recited in claim 12 further comprising remotely generating image data for rendering on another electronic device based on the characterization data and the local data of the electronic device.

17. The system as recited in claim 16 wherein the identifier is unique to the mobile computing device.

18. A mobile device comprising:

a display component, a processor coupled to the display component; and computer readable memory coupled to the processor and storing instruction which, when executed with the processor, cause the mobile device to perform a method of displaying an image, the method comprising:

uploading characterization data and a unique identifier of the mobile device to a server coupled to the mobile device through a communication network, wherein the characterization data represents display properties of the display component, wherein the display properties comprise display capabilities of the mobile device and are generic to content displayed by said electronic device;

requesting transmission of an image content from the server;

collecting and uploading local data to the server, wherein the local data relates to a real-time condition and control data comprising real-time user input to the mobile device with respect to a control setting of the mobile device;

receiving an instance of the image data of the image content and a display control setting transmitted from the server, wherein the instance of image data and display control setting are generated by the server based on the characterization data and the local data; and rendering the instance of image data for display on the display component based on the display control setting.

19. The mobile device as recited in claim 18, wherein the real-time condition comprises a local lighting condition around the display component.

20. The mobile device as recited in claim 18, wherein the display properties comprise one or more optical, electro-optical, photographic, photometric, colorimetric, videographic, and cinematic characteristics of the device.

21. The mobile device as recited in claim 18, wherein the instance of image data represent video content streamed from the server to the mobile device.

22. The mobile device as recited in claim 18, wherein the characterization data is determined based on characterization of another mobile device.

23. The mobile device as recited in claim 22 wherein the instance of image data and the display control setting are generated by the server processing an original instance of image data of the image content based on the characterization data and the local data.

* * * * *